United States Patent [19]

Molnar

[11] Patent Number: 4,961,973

[45] Date of Patent: Oct. 9, 1990

[54] ARTICLES WITH SLIP RESISTANT SURFACES AND METHOD OF MAKING SAME

[75] Inventor: William S. Molnar, Birmingham, Mich.

[73] Assignee: W. S. Molnar Co., Birmingham, Mich.

[21] Appl. No.: 320,904

[22] Filed: Mar. 8, 1989

Related U.S. Application Data

[63] Continuation of Ser. No. 110,950, Oct. 20, 1987, abandoned.

[51] Int. Cl.[5] ..... B05D 1/10

[52] U.S. Cl. ..... 427/423; 428/373

[58] Field of Search ..... 428/373; 427/423

[56] References Cited

U.S. PATENT DOCUMENTS

| | | | |
|---|---|---|---|
| 2,570,649 | 10/1951 | Davidoff | 427/423 X |
| 2,607,983 | 8/1952 | McBride | 427/423 X |
| 2,754,225 | 7/1956 | Gfeller | 427/422 X |
| 3,332,752 | 7/1967 | Batchelor et al. | 427/423 X |
| 3,332,753 | 7/1967 | Batchelor et al. | 427/423 X |
| 3,342,626 | 9/1967 | Batchelor et al. | 427/423 |
| 3,436,248 | 4/1969 | Dittrich et al. | 427/423 X |
| 3,455,019 | 7/1969 | Quaas | 427/423 X |
| 4,076,883 | 2/1978 | Dittrich | 427/423 X |

*Primary Examiner*—Shrive Beck

*Attorney, Agent, or Firm*—Harness, Dickey & Pierce

[57] ABSTRACT

A process for providing a slip resistant surface by thermally applying a metallic spray coat from materials in a hollow wire with the characteristics of the final coated surface being selectively variable by varying the materials in the hollow wire and an article formed by such process, the slip resistant surface on the article being jagged and generally defined by randomly distributed sharp ridges and pointed peaks of varying depths.

36 Claims, 1 Drawing Sheet

ARTICLES WITH SLIP RESISTANT SURFACES AND METHOD OF MAKING SAME

This is a continuation of U.S. Pat. application Ser. No. 07/110,950, filed Oct. 20, 1987 now abandoned.

SUMMARY BACKGROUND OF THE INVENTION

The present invention relates to articles having slip resistant surfaces and to a method of making such articles.

Articles with slip resistant surfaces are utilized primarily in commercial and industrial work or walk areas to inhibit slipping by persons walking or working on such surfaces. Articles with slip resistant surfaces have been heretofore manufactured in numerous forms and by various processes. The present invention relates to articles having such surfaces manufactured by a thermal application of a metallic coat such as by electric (or gas) arc spray. Examples of articles having slip resistant surfaces made by use of electric arc spray are shown in U.S. Pat. No. 4,618,511 for Method for Applying Non-Skid Coating to Metal Bars with Electric Arc or Gas Flame Spray and Article Formed Thereby issued Oct. 21, 1986 to William S. Molnar; U.S. Pat. No. 3,855,444 for Metal Bonded Non-Skid Coating and Method of Making Same issued on Dec. 17, 1974 to Maximillian Palena; and U.S. Pat. No. 4,029,852 for Metal Non-Skid Coating issued on June 14, 1977 to Maximillian Palena. The latter patents show the use of electric arc processing to secure grit to the surface to be roughened. Thus the grit is first applied to the surface of the article and next the grit is bonded to the article surface by metal particles from the electric arc spray utilizing a metal wire as the metal source. With these processes, however, unless special steps are taken the grit can be displaced by virtue of the pressure and/or impact from the metallic spray. The present invention utilizes a unique method for applying a roughened surface to a workpiece. One feature of the invention is to utilize a hollow wire which is filled with metal partial and/or other materials to provide a desired metal alloy or mixture. This technique permits the creation of very hard roughened surfaces by omitting grit and using selected materials which can fuse together to form a desired hard surface. For example, a combination of iron, carbon and aluminum powder fill materials can be used to form a unique rough surface having high hardness. It is also contemplated that grit could be added to the hollow wire such that the grit and metal could be applied simultaneously to the surface to be roughened. The formation of roughened surfaces without grit was suggested in the U.S. Pat. No. 4,618,511 issued to the present inventor; however, conventional solid wires were contemplated whereby advantages of the present invention were not attainable. Also, while the use of hollow, filled wire has heretofore been used with electric arc spraying, such uses have been for applications other than the formation of slip resistant surfaces. Thus the present invention permits the creation of rough, slip resistant surfaces having a variety of desired characteristics depending upon the materials used in the hollow wire. The use of a flexible hollow wire of a ductile material facilitates its use with the desired fill materials. In this regard the ductile filled wire can be readily coiled and fed to arc spray apparatus.

By use of the hollow wire, filled with the desired materials, selected slip resistant patterns can be expeditiously formed on the article resulting in a savings in processing and in materials used to form the slip resistant surface.

Thus it is an object of the present invention to provide a new and unique article having a slip resistant surface.

It is another object of the present invention to provide a novel method for creating a slip resistant surface on an article.

Other objects, features, and advantages of the present invention will become apparent from the subsequent description and the appended claims, taken in conjunction with the accompanying drawings, in which:

Figure 1:
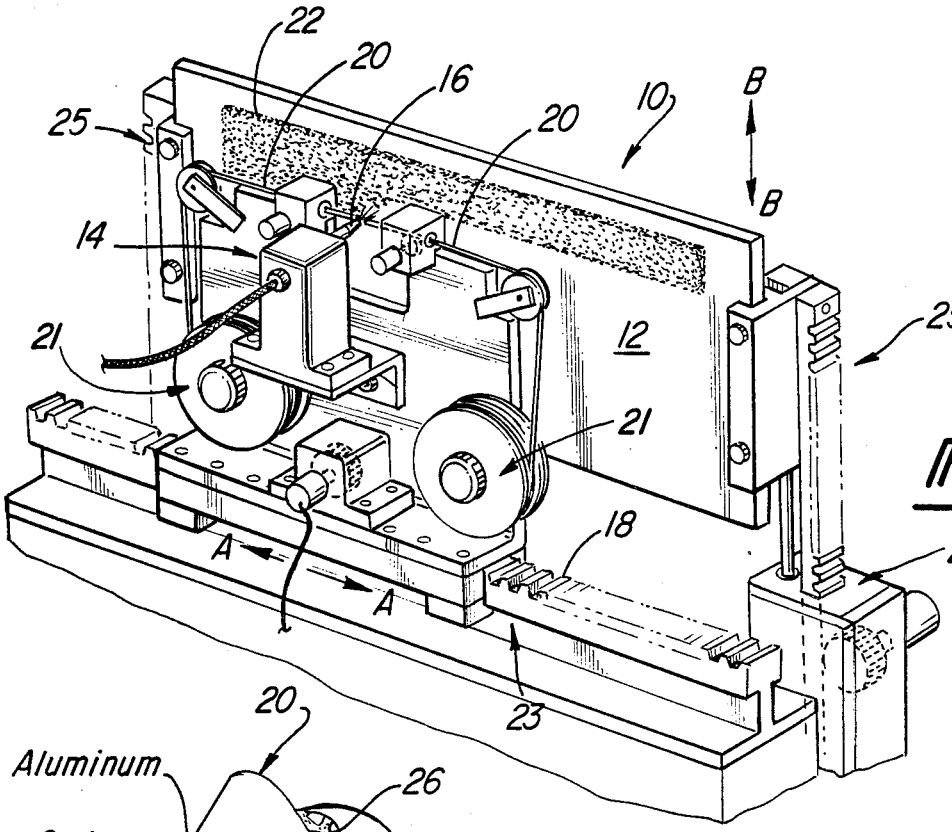
FIG. 1 is a general pictorial view depicting an article being provided with a slip resistant surface by an electric arc spray process utilizing a hollow metal wire filled with a combination of different materials for providing a slip resistant surface on an article.

Looking now to the drawings, an article 10 to be provided with a slip resistant coating on a receiving surface 12 is shown in conjunction with electric arc spray apparatus 14. Typically the article 10 is a flat sheet metal object which can be fabricated into a desired shape, if required, after application of the slip resistant coating. The arc spray apparatus 14 comprises a nozzle or gun 16 used in combination with filled hollow wires 20. Materials of the filled wires 20 are converted to a molten metal or plasma form of spray by an electric (or gas) arc and then atomized and impelled by air pressure against the receiving surface 12 of the article 10. The result is an adherent coating defining a slip resistant surface 22. The distance of the nozzle 16 from the receiving surface 12 can be varied depending upon the material to be processed, the air pressure utilized, etc. Prior to the application of the molten or plasma spray form, the receiving surface 12 is cleaned and/or roughened via grit blasting apparatus (not shown). This can be performed as a separate step or done substantially simultaneously with the application of the coating similarly as shown in the prior U.S. Pat. No. 4,618,511. Thus the grit blasting apparatus provides the desired cleaning and preliminary roughening of the receiving surface 12 such that good adherence of the spray coating can be secured. Other surface preparations can be utilized as noted in U.S. Pat. No. 4,618,511, the disclosure of which patent is incorporated herein by reference.

Thus in operation the article 10 is located generally, on a vertically movable support or conveyor 25 with the receiving surface 12 exposed. The electric arc spray apparatus 14 is located in front of the receiving surface 12. The nozzle 16 of the spray apparatus 14 is actuable to direct a spray of metal droplets onto the receiving surface 12. The metal droplets are formed from the filled wire 20 by an electric (or gas) arc between opposed ends of the wires 20 fed towards each other by spool assemblies 21, with the droplets directed towards the receiving surface 12 by air (or other suitable gas) under pressure. The gas pressure, arcing amperage and the relative distance from the spray nozzle 16 to the receiving surface 12 are selected such that the metal droplets are in a thermally softened or plastic state as they impinge the surface 12 and form a desired coat to define the slip resistant surface 22. The spray apparatus 14 includes a support track assembly 18 which movably supports the spray nozzle or gun 16 for longitudinal reciprocating motion across the receiving surface 12 in the direction of the arrows A-A. Movement can be accomplished via a rack and pinion assembly 23. After a single pass has been completed, the article 10 can be indexed transversely downwardly (in the direction of arrows B). Again such movement can be accomplished by conveyor 25 via a rack and pinion assembly 27. Alternatively the article 10 could be held stationary and the nozzle or gun 16 indexed vertically (by appropriate apparatus). Now an uncoated portion of the receiving surface will be brought in line with the spray nozzle or gun 16 for coating as the nozzle 16 is again moved longitudinally by its support track assembly 18. For a heavier coating the process can be repeated and the article 10 coated a second time. Alternatively, a second set of electric (or gas) arc spray nozzles could be used in tandem with nozzle 16 to form the second metallic coat over the first coat. Of course, further repetitions of the coating process could be made and/or additional nozzles used to provide the final slip resistant surface 22 of desired depth or thickness. While the apparatus of FIG. 1 is shown with the article 10 having its receiving surface 12 in a generally vertical plane, it should be understood that the receiving surface 12 could be horizontally oriented with the nozzle 16 located to direct the spray vertically downwardly. Also note that the details of the spray apparatus 14, the support track assembly 18, rack and pinion assembly 23, conveyor assembly 25, rack and pinion assembly 27 and spool assemblies 21 do not constitute a part of the present invention and hence have been omitted for purposes of simplicity; the apparatus depicted is only by way of a general representation, since the details of such apparatus are within the purview of one skilled in the art.

Skid resistant surfaces formed with grit are subject to wear from abrasion. A substantially all metal surface having a high hardness would be desirable to resist such wear. Such a surface, having improved wear characteristics, can be readily formed by the present invention.

Figure 2:
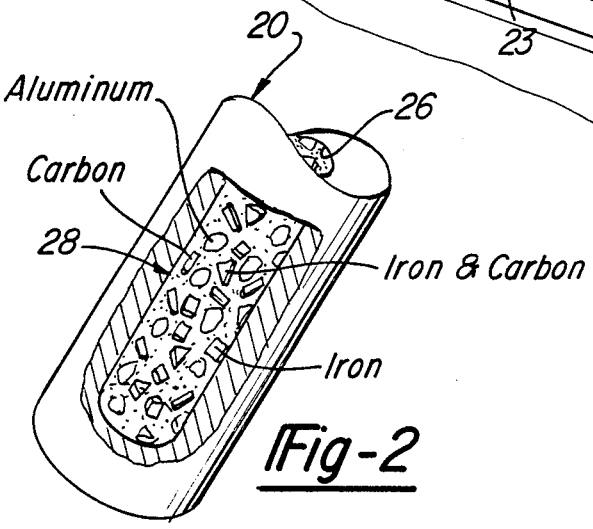
FIG. 2 is an enlarged fragmentary view generally of the hollow metal wire of in FIG. 1, with some parts partially broken away, and with the hollow metal wire shown filled with a combination of different materials for providing a slip resistant surface on an article by an electric arc spray process.

Thus one of the features of the present invention is the use of a hollow wire which is filled with selected materials to provide the slip resistant surface 22 with desired gripping characteristics. One form of the filled wire 20 as selectively filled with such materials is shown in FIG. 2. Thus in FIG. 2 the filled wire 20 includes a hollow wire 26 which is shown with fill materials 28 including iron powder, carbon, iron particles with high carbon content and aluminum powder. It should be noted that the drawing of FIG. 2 is for illustration purposes and is not intended as a representation of particle size or otherwise for dimensional purposes.

Thus in forming such surface having a high hardness it has been found advantageous to utilize a hollow tube filled with the noted materials; the fill materials 28 were relatively proportioned, by weight, with around 93% iron powder, 1% carbon, 1% high carbon iron particles and 5% aluminum. The high carbon iron particles are composed of iron with around 3½%, carbon. In order to facilitate handling of the filled wire 20, as by coiling and feeding via spool assemblies 21, the hollow wire 26 is made of a ductile low carbon steel. In one form of the invention the hollow wire 26 was constructed of 1008 steel with an outside diameter of approximately 1/16". Such a hollow wire 26 comprised between around 60% to around 70% by weight of the filled wire 20 including the noted fill materials 28. Other constructions of the hollow wire 26 could be used such that it would comprise less by weight of the filled wire 20, i.e. between around 30% to around 60%. The total amount of carbon by weight, in the total combination of the hollow wire 26 and fill materials 28, is selected to be between around 0.25% to around 0.70%. Preferably the amount of carbon is selected to be between around 0.30% to around 0.60%. The carbon content is selected to provide with the iron an applied coating having a hard martensitic structure. The amount of aluminum in the total combination of hollow wire 26 and fill materials 28 is selected to be between around 1% to around 3% by weight. The aluminum is believed to enhance bonding of the coating to the substrate and also to inhibit corrosion. The remainder of the material is iron which in the example given will be between around 97% to around 99% by weight of the total combination. The objective here is to select the fill materials 28 relative to the material of the hollow wire 26 to provide the desired slip resistant surface which in this case is of a hard martensitic structure. The resultant coating forms a hard, slip resistant surface of iron alloy having a Rockwell hardness in the range of from around 40 Rc to around 65 Rc; in a preferred form the result was a slip resistant surface having a file hard surface with a Rockwell hardness in the range of from around 50 Rc to around 65 Rc. It should be understood that hardnesses in excess of 65 Rc can be provided. The latter surface includes an iron alloy which is generally martensitic in nature and is preferably formed on an article 10 constructed of a ferrous material. In order for the coating to provide a slip resistant surface which has a high hardness or is martensitic in nature the fill materials 28 and the hollow wire 26 must be heated to their alloying temperatures as the metal droplets are formed. Thus it is believed that in the electric arc process the molten droplets attain a temperature of no less than around 1500° C. This can be readily accomplished with electric arc spray apparatus. At the same time the molten materials are quickly air quenched as the droplets are impelled by compressed air and impinge against the receiving surface 12. Note that the hollow wire 26 is ductile and hence facilitates handling; in this regard it can be readily coiled and fed to the arc spray apparatus 14. If a hard alloy steel are were used, coiling and feeding would be inhibited. Thus the hollow wire 26 of ductile material filled with the desired fill materials 28 is advantageous. In addition the fill materials 28 can be readily, selectively varied for different applications.

In one form of the invention the arc spray apparatus 14 utilized a nozzle or gun 16 which was a Model No. 8830 manufactured by Tafa Incorporated; an electric arc current of around 300 amperes was provided with an air pressure of around 35 psi with the nozzle 16 located around 6 inches from the receiving surface 12 of an article 10 made of a ferrous material. With the hollow wire 26 filled with iron powder, iron particles with high carbon content, carbon and aluminum generally in the previously noted proportions a slip resistant surface was formed which was martensitic in nature and with a Rockwell hardness in the range of from around 40 Rc to around 65 Rc.

An advantage of the latter coatings formed without grit is in their weldability. Thus the article 10 coated with a slip resistant surface 34 having no grit can be readily welded to another structure without first grinding to remove grit.

One feature of the present invention is to utilize a mixture of grit, metal powder, and other materials in the hollow wire. In this way the grit and metal are applied simultaneously to the surface to be roughened. The grit can comprise between around 25% to around 50% by volume of the fill materials 28. The contents of the remaining materials could be varied from that previously noted such that these remaining materials in combination with the hollow wire 26 would provide between around 1% to around 3% by weight of aluminum, around 97% to around 99% iron with sufficient carbon to provide between around 0.25% to around 0.70% carbon by weight and preferably between around 0.30% to around 0.60% carbon by weight. The weight of the grit, of course, is not included in the noted combination of remaining materials and hollow wire 26. Thus the amount of pure carbon added in the fill material 28 takes into account the carbon in the hollow wire 26 and in the iron particles with high carbon content to provide the selected overall carbon and iron content to produce the desired iron alloy as noted.

A significant advantage of the present invention also is in the ability to vary the composition of the coating materials to suit different needs. For example very hard slip resistant surfaces having good wear properties can be provided as noted. In addition, slip resistant surfaces having resistance to corrosion or general resistance to a known environment (chemical) can be provided simply by varying the composition of the fill materials 28 in the hollow wire 26. For example chromium, molybdenum, alloyed materials such as stainless steel and other elements could be added to provide desired characteristics to the final coating. At the safe time the depth or thickness of the slip resistant surface 22 can be readily controlled, especially where grit is eliminated and metals are the dominant ingredients; in this case the slip resistant surface 22 can be provided to have selected frictional characteristics, for example, from that of a fine sandpaper (fine grade slip resistant surface) to that of a coarse sandpaper (coarse grade slip resistant surface). As will be seen the slip resistant surface 22 is comprised of randomly formed ridges and peaks of varying depth or thickness. For a coarse grade surface the coating is of a varying depth having at least portions with a depth preferably no less than around 0.015"; for a medium grade surface the coating is of a varying depth having at least portions with a depth of around 0.010", such depth being the maximum depth of the coating; and for a fine grade rough surface the coating is of a varying depth having at least portions with a depth of around 0.005" such depth being the maximum depth of the coating. Thus in some work environments where it is expected that the workers will be engaged in a pivoting action at their work station the fine grade slip resistant surface may be desirable and can be readily provided by the present invention.

Figure 3:
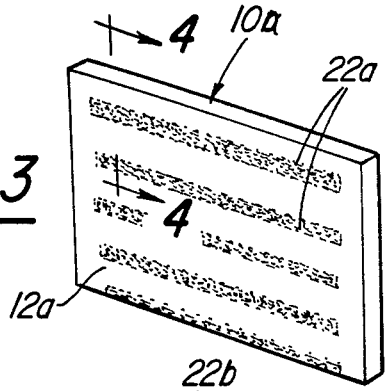
FIG. 3 is a pictorial view depicting a desired slip resistant pattern formed on an article by an electric arc spray process.
Figure 5:
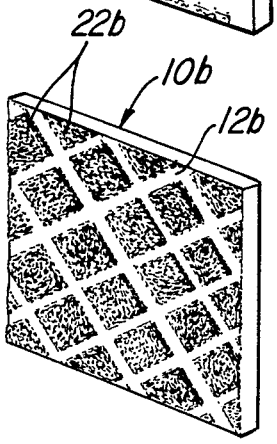
FIG. 5 is a pictorial view depicting a different desired slip resistant pattern formed on an article by an electric arc spray.

Another advantage of the invention is that the slip resistant surface can be readily formed in a pattern. In FIG. 1 the article 10 is shown to have its receiving surface 12 substantially completely coated with a slip resistant surface 22. In contrast, FIGS. 3 and 5 show different patterns that could be utilized and still provide good slip resistant characteristics. Thus FIG. 3 shows the article **10*a* with a patterned slip resistant surface 22*a*. In this regard it is believed that a patterned surface 22*a* should cover no less than around 30% of the area of the receiving surface 12*a* and no greater than around 80% of the area of the receiving surface 12*a*. The patterned surface 22*a* of FIG. 3 can be provided by simply appropriately indexing the nozzle 16 and article 10*a* relative to each other to form the desired pattern of spaced, generally parallel lines. In this case there will be a resultant savings in spray material. FIG. 5 shows an article 10*b* with a pattern of squares defining the patterned slip resistant surface 22*b* on the receiving surface 12*b*. With more complex shapes such as that shown in FIG. 5**, a grid or pattern overlay could be used to shield those areas which are not to be sprayed.

Figure 4:
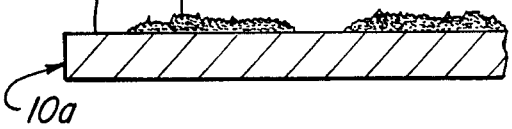
FIG. 4 is a sectional view to enlarged scale of the article of FIG. 3 with a slip resistant pattern.

One advantage of having a patterned surface is in providing generally uncoated areas which are at a lower level (i.e. of lesser overall thickness) than the coated areas and which can act to collect fluids on the article and facilitate cleaning, see FIGS. 3, 4, and 5. In addition, the coated areas defining the slip resistant surfaces **22*a* and 22*b*, as shown in FIGS. 3 and 5, can be a series of unconnected lines or surface portions whereby the generally uncoated areas are in communication with each other to further facilitate the removal or drainage of fluids from the articles 10*a* and 10*b***. In these latter cases a depth of coating of no less than around 0.010" to around 0.015" is desirable.

Figure 6:
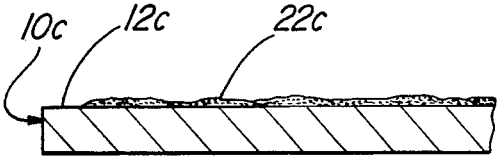
FIG. 6 is a sectional view to enlarged scale of an article having a slip resistant surface including grit.

An examination of a slip resistant surface **22*c* formed on a receiving surface 12*c* on an article 10*c* with grit shows it to be relatively rough but substantially without sharp edges or peaks. (See FIG. 6). On the other hand the surfaces such as slip resistant surfaces 22, 22*a* and 22*b* formed without grit are jagged and generally composed of sharp ridges and/or pointed peaks of random orientation and varying heights or depths. FIG. 4 is a pictorial representation of a portion of the slip resistant surface 22*a* on article 10*a* with such sharp projections, i.e. sharp ridges and/or pointed peaks. Thus in the latter case as one set of ridges and peaks wears other, adjacent sharp ridges and pointed peaks of lesser depth will be exposed whereby the effectiveness of the slip resistant surface 22*a*** can be maintained high despite initial wear. It might be expected that such ridges and peaks would be susceptible to wear. However by forming the slip resistant coating to be very hard, the strength of these ridges and peaks is optimized making such a construction more durable than if a lower strength material were employed as the coating.

While it will be apparent that the preferred embodiments of the invention disclosed are well calculated to fulfill the objects above stated, it will be appreciated that the invention is susceptible to modification variation and change without departing from the proper scope or fair meaning of the invention.

What is claimed is:

1. A process for forming an adherent rough coating on a receiving surface of an article to provide a slip resistant surface for persons walking or working thereon comprising the steps of:

providing a hollow wire filled with fill materials including iron and alloying elements with iron, said hollow wire being constructed from iron, thermally acting on said hollow wire and said materials to heat said iron to its alloying temperature to provide molten metal droplets forming an iron alloy including at least some of said fill materials, directing said molten metal droplets as a spray against said receiving surface to form an adherent rough coating defining a slip resistant surface for persons walking or working thereon, said slip resistant surface of said iron alloy having a hardness of between around 40 Rc to around 65 Rc.

2. The process of claim 1 with said fill materials and said hollow wire forming said molten metal droplets comprising mainly iron and with said slip resistant surface having a hardness of between around 50 Rc to around 65 Rc.

3. The process of claim 1 with said molten metal droplets comprising, by weight, mainly iron and between around 0.25% to around 0.70% carbon.

4. The process of claim 1 with the combined materials forming said molten metal droplets comprising, by weight, mainly iron and between around 0.30% to around 0.60% carbon.

5. The process of claim 1 with the combined materials forming said molten metal droplets comprising, by weight, between around 0.25% to around 0.70% carbon, and between around 1% to around 3% aluminum and the remainder being substantially iron.

6. The process of claim 1 with the combined materials forming said molten metal droplets comprising, by weight, between around 0.30% to around 0.60% carbon, and between 1% to around 3% aluminum and the remainder being substantially iron.

7. The process of claim 1 with said fill materials further including grit particles.

8. The process of claim 1 with said fill materials including generally between around 25% to around 50% by volume of grit particles and the remainder of said fill materials and said hollow wire providing said metal droplets.

9. The process of claim 1 with said fill materials including between around 25% to around 50% by volume of grit particles and the remainder of materials including said fill materials and said hollow wire including a metal from the group including aluminum and iron.

10. The process of claim 1 with said fill materials including between around 25% to around 50% by volume of grit particles and the rest of said fill materials and said hollow wire, comprising, by weight, between around 0.25% to around 0.70% carbon and the remainder being substantially iron.

11. The process of claim 1 with said fill materials including between around 25% to around 50% by volume of grit particles and the rest of said fill materials and said hollow wire comprising, by weight, between around 0.25% to around 0.70% carbon, between around 1% to around 3% aluminum and the remainder being substantially iron.

12. The process of claim 1 with said iron alloy in said slip resistant surface being generally martensitic in nature.

13. The process of claim 1 with said hollow wire being of a generally ductile material.

14. The process of claim 1 with said hollow wire being of a generally ductile material providing by weight between around 30% to around 70% of the iron of said hollow wire and said fill materials combined.

15. In a process for forming a product having an adherent rough coating on a receiving surface to provide a slip resistant surface for persons walking or working thereon, the product formed by such process including the steps of:

providing a hollow wire filled with fill materials including iron and alloying elements with iron, thermally acting on said hollow wire and said fill materials to heat said iron to its alloying temperature and to provide molten metal droplets forming an iron alloy including said alloying elements, directing said molten metal droplets as a spray against said receiving surface to form an adherent rough coating defining a slip resistant surface for persons walking or working thereon, said slip resistant surface being formed with said iron alloy having a Rockwell hardness of between around 40 Rc to around 65 Rc.

16. The process for forming the product of claim 15 with the combined materials forming said molten metal droplets comprising, by weight, mainly iron and between around 0.25% to around 0.70% carbon.

17. The process for forming the product of claim 15 with the combined materials forming said molten metal droplets comprising by weight mainly iron and between around 0.30% to around 0.60% carbon.

18. The process for forming the product of claim 15 with the combined materials forming said molten metal droplets comprising, by weight, between around 0.25% to around 0.70% carbon, and between around 1% to around 3% aluminum and the remainder being substantially iron.

19. The process for forming the product of claim 15 with the combined materials forming said molten metal droplets comprising, by weight, between around 0.30% to around 0.60% carbon, between 1% to around 3% aluminum and the remainder being substantially iron.

20. The process for forming the product of claim 15 with said fill materials further including grit particles.

21. The process for forming the product of claim 15 with said materials including between around 25% to around 50% by volume of grit particles and with the rest of said fill materials and said hollow wire providing said metal droplets.

22. The process for forming the product of claim 15 with said materials including between around 25% to around 50% by volume of grit particles and with the rest of said fill materials including a metal selected from the group consisting of aluminum and iron.

23. The process for forming the product of claim 15 with said fill materials including between around 25% to around 50% by volume of grit particles and the rest of said fill materials including said wire, comprising by weight, between around 0.25% to around 0.70% carbon and the remainder being substantially iron.

24. The process for forming the product of claim 15 with said fill materials including between around 25% to around 50% by volume of grit particles and the rest of said fill materials with said wire comprising, by weight, between around 0.25% to around 0.70% carbon, between around 1% to around 3% aluminum and the remainder being substantially iron.

25. The process for forming the product of claim 15 with said hollow wire being of a generally ductile material.

26. The process for forming the product of claim 15 with said hollow wire being of a generally ductile material providing by weight between around 30% to around 70% of the iron of said hollow wire and said fill materials combined.

27. The process for forming the product of claim 15 with said iron alloy in said slip resistant surface having a Rockwell hardness of between around 50 Rc to around 60 Rc.

28. In a process for forming a product having an adherent rough coating on a receiving surface to provide a slip resistant surface for persons walking or working thereon, the product formed by such process including the steps of:

providing a hollow wire filled with fill materials including iron and alloying elements with iron, thermally acting on said hollow wire and said fill materials to heat said iron to its alloying temperature and to provide molten metal droplets forming an iron alloy including said alloying elements, directing said molten metal droplets as a spray against said receiving surface to form an adherent rough coating defining a slip resistant surface for persons walking or working thereon, said slip resistant surface being jagged and generally defined by randomly distributed sharp ridges and pointed peaks of varying depths, said slip resistant surface being formed with said iron alloy having a Rockwell hardness of between around 40 Rc to around 65 Rc.

29. The process for forming the product of claim 27 with said iron alloy in said slip resistant surface being generally martensitic in nature, said iron alloy in said slip resistant surface having a Rockwell hardness of between around 40 Rc to at least around 65 Rc.

30. The process for forming the product of claim 28 with said iron alloy in said slip resistant surface having a Rockwell hardness of between around 50 Rc to at least around 65 Rc.

31. A process for forming an adherent, rough coating on a receiving surface on an article to provide a slip resistant surface for persons walking or working thereon comprising the steps of:

providing a hollow wire filled with fill materials including iron and alloying elements with iron, thermally acting on said hollow wire and said fill materials to heat said iron to its alloying temperature to provide molten metal droplets forming an iron alloy, directing said molten metal droplets as a spray against said receiving surface to form an adherent rough coating defining a slip resistant surface for persons walking or working thereon, said molten metal droplets being directed by spray apparatus, and selectively controlling said spray apparatus relative to said receiving surface to spray said metal droplets to form a preselected coating pattern on said receiving surface of coated and generally uncoated portions, said coated portions being formed with said iron alloy having a Rockwell hardness of between around 40 Rc to around 65 Rc.

32. The process of claim 31 with said coated portions covering no less than around 30% and no greater than around 80% of the area of said receiving surface.

33. The process of claim 31 with said coated portions being formed to a depth of at least around 0.010′ whereby said generally uncoated portions of said receiving surface can collect fluids.

34. In a process for forming a product having an adherent, rough coating on a receiving surface to provide a slip resistant surface for persons walking or working thereon the process comprising the steps of:

providing a hollow wire filled with fill materials including iron and alloying elements with iron, thermally acting on said hollow wire and said fill materials to heat said iron to its alloying temperature to provide molten metal droplets, directing said molten metal forming an iron alloy droplets as a spray against said receiving surface to form an adherent rough coating defining a slip resistant surface for persons walking or working thereon, said molten metal droplets being directed by spray apparatus, and selectively controlling said spray apparatus relative to said receiving surface to spray said metal droplets to form a preselected coating pattern on said receiving surface of coated and generally uncoated portions, said slip resistant surface being jagged and generally defined by randomly distributed sharp ridges and pointed peaks of varying depths, said slip resistant surface being formed of an iron alloy having a Rockwell hardness of from around 40 Rc to around 65 Rc.

35. The process for forming the product of claim 34 with said coated portions covering no less than around 30% and no greater than around 80% of the area of said receiving surface.

36. The process for forming the product of claim 34 with said coated portions being formed to a random depth with the maximum depth being no less than around 0.010″ whereby said generally uncoated portions of said receiving surface can collect fluids.

* * * * *

UNITED STATES PATENT AND TRADEMARK OFFICE

CERTIFICATE OF CORRECTION

PATENT NO. : 4,961,973

DATED : October 9, 1990

INVENTOR(S) : William S. Molnar

It is certified that error appears in the above-identified patent and that said Letters Patent is hereby corrected as shown below:

Column 1, line 43, delete "partial" and substitute therefore --particles--.
Column 2, line 22, delete "in".
Column 4, line 59, delete "are" and substitute therefor --wire--.
Column 9, Claim 29, delete lines 35-39.
Column 10, line 17, Claim 33, delete "0.010'" and substitute therefor --0.010"--.
Column 10, line 28, Claim 34, after "droplets" insert --forming an iron alloy--.

Title page, "36 Claims" should read --35 Claims--.

Signed and Sealed this

Thirteenth Day of July, 1993

*Attest:*

Michael K. Kirk

MICHAEL K. KIRK

*Attesting Officer*

*Acting Commissioner of Patents and Trademarks*